US010682694B2

(12) United States Patent
Schramm et al.

(10) Patent No.: US 10,682,694 B2
(45) Date of Patent: Jun. 16, 2020

(54) FEEDBACK-ASSISTED RAPID DISCHARGE HEATING AND FORMING OF METALLIC GLASSES

(71) Applicant: Glassimetal Technology, Inc., Pasadena, CA (US)

(72) Inventors: Joseph P. Schramm, Sierra Madre, CA (US); Marios D. Demetriou, West Hollywood, CA (US); William L. Johnson, San Marino, CA (US)

(73) Assignees: Glassimetal Technology, Inc., Pasadena, CA (US); Apple Inc., Cupertino, CA (US)

( * ) Notice: Subject to any disclaimer, the term of this patent is extended or adjusted under 35 U.S.C. 154(b) by 571 days.

(21) Appl. No.: 15/406,436

(22) Filed: Jan. 13, 2017

(65) Prior Publication Data

US 2017/0203358 A1 Jul. 20, 2017

Related U.S. Application Data

(60) Provisional application No. 62/278,781, filed on Jan. 14, 2016.

(51) Int. Cl.

| | |
|---|---|
| ***C21D 1/40*** | (2006.01) |
| ***C21D 11/00*** | (2006.01) |
| ***B22D 21/00*** | (2006.01) |
| ***B22D 17/08*** | (2006.01) |
| ***B22D 25/06*** | (2006.01) |
| ***B22D 17/32*** | (2006.01) |
| ***C22C 16/00*** | (2006.01) |
| ***B21J 1/00*** | (2006.01) |

(52) U.S. Cl.
CPC ..... *B22D 21/005* (2013.01); *B21J 1/006* (2013.01); *B22D 17/08* (2013.01); *B22D 17/32* (2013.01); *B22D 25/06* (2013.01); *C21D 1/40* (2013.01); *C21D 11/00* (2013.01); *C22C 16/00* (2013.01)

(58) Field of Classification Search
None
See application file for complete search history.

(56) References Cited

U.S. PATENT DOCUMENTS

| | | | |
|---|---|---|---|
| 2,467,782 | A | 12/1947 | Schuman |
| 2,816,034 | A | 12/1957 | Mittelmann |
| 3,241,956 | A | 3/1966 | Inoue |
| 3,250,892 | A | 5/1966 | Inoue |
| 3,332,747 | A | 7/1967 | Bundy |

(Continued)

FOREIGN PATENT DOCUMENTS

| | | |
|---|---|---|
| CN | 1552940 | 12/2004 |
| CN | 1689733 | 11/2005 |

(Continued)

OTHER PUBLICATIONS

Johnson et al., "A Universal Criterion for Plastic Yielding of Metallic Glasses with a (T/Tg)2/3 Temperature Dependence," *Physical Review Letter*, (2005), PRL 95, pp. 195501-195501-4.

(Continued)

*Primary Examiner* — George Wyszomierski
(74) *Attorney, Agent, or Firm* — Polsinelli PC

(57) ABSTRACT

The disclosure is directed to an apparatus comprising feedback-assisted control of the heating process in rapid discharge heating and forming of metallic glass articles.

17 Claims, 5 Drawing Sheets

(56) References Cited

U.S. PATENT DOCUMENTS 3,537,045 A 10/1970 Ichiro
3,863,700 A 2/1975 Bedell et al.
4,115,682 A 9/1978 Kavesh et al.
4,355,221 A 10/1982 Lin
4,462,092 A 7/1984 Kawabuchi et al.
4,523,748 A 6/1985 Latter
4,571,414 A 2/1986 Renlund et al.
4,715,906 A 12/1987 Taub et al.
4,809,411 A 3/1989 Lin et al.
4,950,337 A 8/1990 Li et al.
5,005,456 A 4/1991 Ballard et al.
5,069,428 A 12/1991 Li et al.
5,075,051 A 12/1991 Ito et al.
5,101,186 A * 3/1992 Durum ..... H01H 83/20 335/23
5,196,264 A 3/1993 Tsuchiya et al.
5,220,349 A * 6/1993 Saita ..... B41J 2/3555 219/216
5,278,377 A 1/1994 Tsai
5,288,344 A 2/1994 Peker et al.
5,324,368 A 6/1994 Masumoto et al.
5,368,659 A 11/1994 Peker et al.
5,427,660 A 6/1995 Kamimura et al.
5,550,857 A 8/1996 Richards
5,554,838 A 9/1996 Berdich
5,618,359 A 4/1997 Lin et al.
5,735,975 A 4/1998 Lin et al.
5,896,642 A 4/1999 Peker et al.
6,027,586 A 2/2000 Masumoto et al.
6,235,381 B1 5/2001 Sanders et al.
6,258,183 B1 7/2001 Onuki et al.
6,279,346 B1 8/2001 Ribes et al.
6,293,155 B1 9/2001 Babiel
6,355,361 B1 3/2002 Ueno et al.
6,432,350 B1 8/2002 Seres et al.
6,631,752 B2 * 10/2003 McDonald ..... B22D 17/32 164/4.1
6,771,490 B2 8/2004 Peker et al.
6,875,293 B2 4/2005 Peker
7,120,185 B1 10/2006 Richards
7,347,967 B2 3/2008 Kim et al.
7,506,566 B2 3/2009 Decristofaro et al.
7,883,592 B2 2/2011 Hofmann et al.
8,099,982 B2 1/2012 Takagi et al.
8,276,426 B2 10/2012 Musat et al.
8,499,598 B2 8/2013 Johnson et al.
8,613,813 B2 12/2013 Johnson et al.
8,613,814 B2 12/2013 Kaltenboeck et al.
8,613,815 B2 12/2013 Johnson et al.
8,613,816 B2 12/2013 Kaltenboeck et al.
8,776,566 B2 7/2014 Johnson et al.
8,961,716 B2 2/2015 Demetriou et al.
9,044,800 B2 6/2015 Johnson et al.
9,067,258 B2 6/2015 Schramm et al.
9,297,058 B2 3/2016 Demetriou et al.
9,309,580 B2 4/2016 Schramm et al.
9,393,612 B2 7/2016 Schramm et al.
9,463,498 B2 10/2016 Johnson et al.
9,539,628 B2 1/2017 Poole et al.
9,845,523 B2 12/2017 Schramm et al.
10,213,822 B2 2/2019 Lee et al.
10,248,004 B2 4/2019 Dussauze et al.
10,273,568 B2 4/2019 Lee et al.
2001/0033304 A1 10/2001 Ishinaga et al.
2002/0100573 A1 8/2002 Inoue et al.
2002/0122985 A1 9/2002 Sato et al.
2003/0056562 A1 3/2003 Kamano
2003/0183310 A1 10/2003 McRae
2003/0222122 A1 12/2003 Johnson et al.
2004/0035502 A1 2/2004 Kang et al.
2004/0067369 A1 4/2004 Ott et al.
2005/0034787 A1 2/2005 Song et al.
2005/0103271 A1 5/2005 Watanabe et al.
2005/0202656 A1 9/2005 Ito et al.
2005/0217333 A1 10/2005 Daehn
2005/0236071 A1 10/2005 Koshiba et al.
2005/0263216 A1 12/2005 Chin et al.
2006/0102315 A1 5/2006 Lee et al.
2006/0293162 A1 12/2006 Ellison
2007/0003782 A1 1/2007 Collier
2007/0023401 A1 2/2007 Tsukamoto et al.
2007/0034304 A1 2/2007 Inoue et al.
2008/0081213 A1 4/2008 Ito et al.
2008/0110864 A1 * 5/2008 Oussalem ..... A01L 11/00 219/50
2008/0135138 A1 6/2008 Duan et al.
2008/0302775 A1 12/2008 Machrowicz
2009/0236017 A1 9/2009 Johnson et al.
2009/0246070 A1 10/2009 Tokuda et al.
2010/0009212 A1 1/2010 Utsunomiya et al.
2010/0047376 A1 2/2010 Imbeau et al.
2010/0121471 A1 5/2010 Higo et al.
2010/0243618 A1 * 9/2010 Shibagaki ..... H01L 21/046 219/121.23
2010/0320195 A1 12/2010 Fujita et al.
2011/0048587 A1 3/2011 Vecchio et al.
2012/0006085 A1 1/2012 Johnson et al.
2012/0103478 A1 5/2012 Johnson et al.
2012/0132625 A1 5/2012 Kaltenboeck et al.
2012/0255338 A1 10/2012 Johnson et al.
2012/0268079 A1 * 10/2012 Nakamura ..... H02J 7/0031 320/166
2013/0001222 A1 1/2013 Kaltenboeck et al.
2013/0025814 A1 1/2013 Demetriou et al.
2013/0048152 A1 2/2013 Na et al.
2013/0112321 A1 5/2013 Poole et al.
2013/0319062 A1 12/2013 Johnson et al.
2014/0033787 A1 2/2014 Johnson et al.
2014/0045680 A1 2/2014 Nakayama et al.
2014/0047888 A1 2/2014 Johnson et al.
2014/0083150 A1 3/2014 Kaltenboeck et al.
2014/0102163 A1 4/2014 Kaltenboeck et al.
2014/0130563 A1 5/2014 Lee et al.
2014/0283956 A1 9/2014 Schramm et al.
2015/0090375 A1 4/2015 Lee et al.
2015/0096967 A1 4/2015 Lee et al.
2015/0231675 A1 8/2015 Johnson et al.
2015/0299825 A1 10/2015 Prest et al.
2015/0367410 A1 12/2015 Schramm et al.
2016/0008870 A1 1/2016 Schramm et al.
2016/0298205 A1 10/2016 Johnson et al.
2018/0065173 A1 3/2018 Crewdson et al.

FOREIGN PATENT DOCUMENTS

CN 101053281 10/2007
CN 201838352 5/2011
CN 103320783 9/2013
EP 0921880 6/1999
EP 2556178 2/2013
FR 2806019 9/2001
GB 215522 5/1924
GB 2148751 6/1985
JP 48-008694 3/1973
JP 63-220950 9/1988
JP H06-57309 3/1994
JP H06-277820 10/1994
JP H 08-024969 1/1996
JP 08-300126 11/1996
JP 10-263739 10/1998
JP 10-296424 11/1998
JP 11-001729 1/1999
JP 11-104810 4/1999
JP 11-123520 11/1999
JP 11-354319 12/1999
JP 2000-119826 4/2000
JP 2000-169947 6/2000
JP 2001-321847 11/2001
JP 2001-347355 12/2001
JP 2003-509221 3/2003
JP 2005-209592 8/2005
JP 2008-000783 1/2008
JP 2011-517623 6/2011
JP 2013-530045 7/2013

(56) References Cited

FOREIGN PATENT DOCUMENTS

| | | |
|---|---|---|
| KR | 10-0271356 | 11/2000 |
| WO | WO 01/21343 | 3/2001 |
| WO | WO 2009/048865 | 4/2009 |
| WO | WO 11/127414 | 10/2011 |
| WO | WO 12/051443 | 4/2012 |
| WO | WO 12/092208 | 7/2012 |
| WO | WO 12/103552 | 8/2012 |
| WO | WO 12/112656 | 8/2012 |
| WO | WO 2014/078697 | 5/2014 |

OTHER PUBLICATIONS

Demetriou, Document cited and published during Applicant Interview Summary conducted on Jan. 29, 2013, entitled, "Rapid Discharge Heating & Forming of Metallic Glasses: Concepts, Principles, and Capabilities," Marios Demetriou, 20 pages.

De Oliveira et al., "Electromechanical engraving and writing on bulk metallic glasses", Applied Physics Letters, Aug. 26, 2002, vol. 81, No. 9, pp. 1606-1608.

Duan et al., "Bulk Metallic Glass with Benchmark Thermoplastic Processability", Adv. Mater., 2007, vol. 19, pp. 4272-4275.

Ehrt et al., "Electrical conductivity and viscosity of borosilicate glasses and melts," Phys. Chem. Glasses: Eur. J. Glass Sci. Technol. B, Jun. 2009, 50(3), pp. 165-171.

Love, "Temperature dependence of electrical conductivity and the probability density function," J. Phys. C: Solid State Phys., 16, 1983, pp. 5985-5993.

Mattern et al., "Structural behavior and glass transition of bulk metallic glasses," Journal of Non-Crystalline Solids, 345&346, 2004, pp. 758-761.

Wiest et al., "Zi—Ti-based Be-bearing glasses optimized for high thermal stability and thermoplastic formability", Acta Materialia, 2008, vol. 56, pp. 2625-2630.

Yavari et al., "Electromechanical shaping, assembly and engraving of bulk metallic glasses", Materials Science and Engineering A, 2004, vol. 375-377, pp. 227-234.

Yavari et al., "Shaping of Bulk Metallic Glasses by Simultaneous Application of Electrical Current and Low Stress", Mat. Res. Soc. Symp. Proc., 2001, vol. 644, pp. L12.20.1-L12.20.6.

Saotome et al., "Characteristic behavior of Pt-based metallic glass under rapid heating and its application to microforming," *Materials Science and Engineering A*, 2004, vol. 375-377, pp. 389-393.

Kulik et al., "Effect of flash- and furnace annealing on the magnetic and mechanical properties of metallic glasses," *Materials Science and Engineering*, A133 (1991), pp. 232-235.

Masuhr et al., Time Scales for Viscous Flow, Atomic Transport, and Crystallization in the Liquid and Supercooled Liquid States of Zr41.2Ti13.8Cu12.5Ni10.0Be22.5,: *Phys. Rev. Lett.*, vol. 82, (1999), pp. 2290-2293.

Schroers et al., "Pronounced asymmetry in the crystallization behavior during constant heating and cooling of a bulk metallic glass-forming liquid," Phys. Rev. B, vol. 60, No. 17 (1999), pp. 11855-11858.

* cited by examiner

FEEDBACK-ASSISTED RAPID DISCHARGE HEATING AND FORMING OF METALLIC GLASSES

CROSS-REFERENCE TO RELATED PATENT APPLICATION

This patent application claims the benefit of U.S. patent application Ser. No. 62/278,781, entitled "FEEDBACK-ASSISTED RAPID DISCHARGE HEATING AND FORMING OF METALLIC GLASSES," filed on Jan. 14, 2016 under 35 U.S.C.§ 119(e), which is incorporated herein by reference in its entirety.

FIELD

The disclosure is directed to an apparatus including feedback-assisted control of the heating process in rapid discharge heating and forming (RDHF) of metallic glasses.

BACKGROUND

U.S. Pat. No. 8,613,813 entitled "Forming of Metallic Glass by Rapid Capacitor Discharge" is directed, in certain aspects, to a rapid discharge heating and forming method (RDHF method), in which a metallic glass is rapidly heated and formed into an amorphous article by discharging an electrical energy through a metallic glass sample cross-section to rapidly heat the feedstock to a process temperature in the range between the glass transition temperature of the metallic glass and the equilibrium liquidus temperature of the glass-forming alloy (termed the "undercooled liquid region") and shaping and then cooling the sample to form an amorphous article.

U.S. Pat. No. 8,613,813 is also directed, in certain aspects, to a rapid discharge heating and forming apparatus (RDHF apparatus), which includes a metallic glass feedstock, a source of electrical energy, at least two electrodes interconnecting the source of electrical energy to the metallic glass feedstock, where the electrodes are attached to the feedstock such that connections are formed between the electrodes and the feedstock, and a shaping tool disposed in forming relation to the feedstock. In the disclosed apparatus, the source of electrical energy is capable of producing electrical energy uniformly through a sample such that the generated electrical current heats the entirety of the sample to a process temperature between the glass transition temperature of the amorphous material and the equilibrium liquidus temperature of the alloy, while the shaping tool is capable of applying a deformational force to form the heated sample to a net shape article.

BRIEF DESCRIPTION OF FIGURES

The description will be more fully understood with reference to the following figures and data graphs, which are presented as various embodiments of the disclosure and should not be construed as a complete recitation of the scope of the disclosure.

BRIEF SUMMARY

Figure 1:
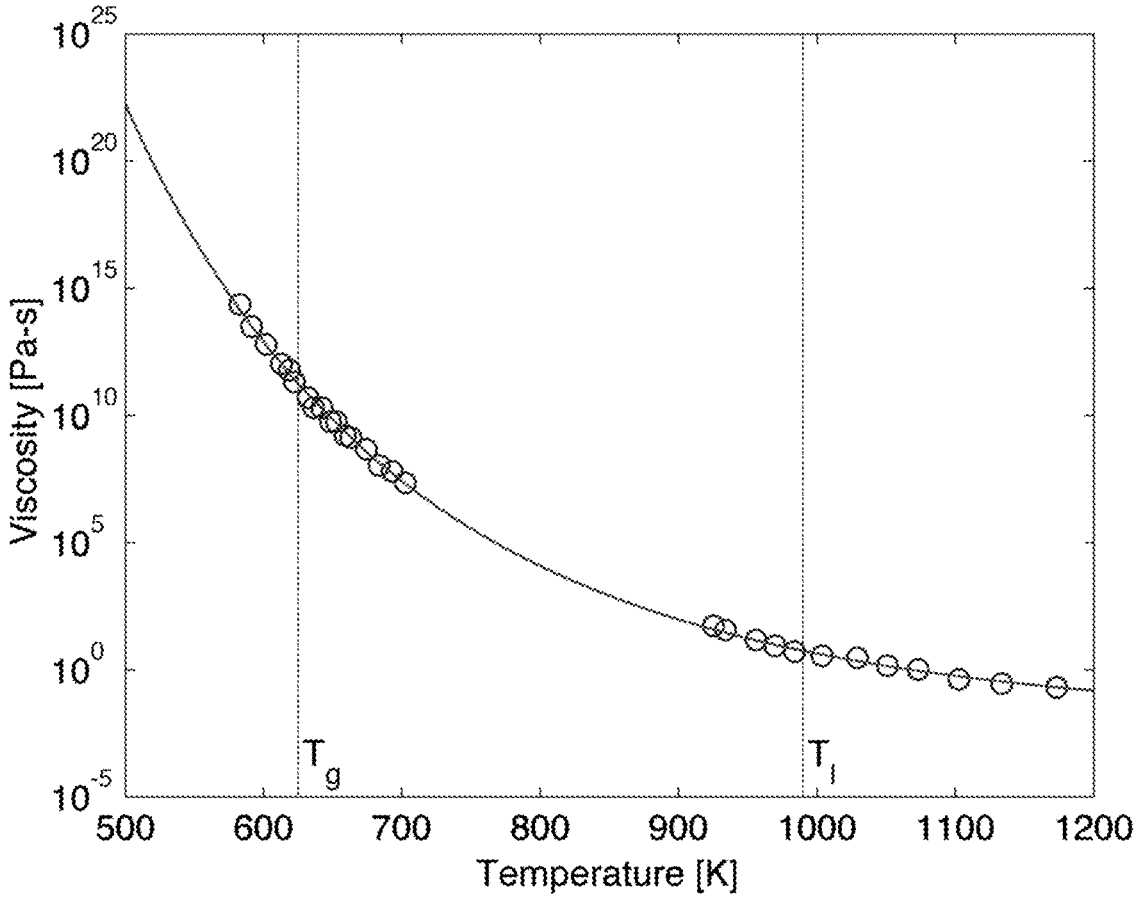
FIG. 1 presents a plot of the viscosity of example metallic glass $Zr_{41.2}Ti_{13.8}Cu_{12.5}Ni_{10}Be_{22.5}$ against temperature in the undercooled liquid region (i.e. between the glass-transition temperature, $T_g$, and liquidus temperature, $T_l$, in accordance with embodiments of the disclosure.

The disclosure is directed to an apparatus including feedback-assisted control of the heating process in rapid discharge heating and forming of metallic glass articles.

In some embodiments, the disclosure is directed to an RDHF apparatus including an electrical circuit that includes a source of electrical energy, a metallic glass feedstock sample, at least two electrodes interconnecting the source of electrical energy to the sample, and a feedback control loop. The RDHF apparatus also includes a shaping tool disposed in forming relation to the sample.

The feedback control loop according to embodiments of the disclosure includes a temperature-monitoring device, a computing device, and a current interrupting device. The temperature-monitoring device is disposed in temperature monitoring relationship with the sample, and is configured to generate a signal indicative of the temperature of the sample. The computing device is in communication with the temperature-monitoring device, and is configured to convert the signal from the temperature-monitoring device to a sample temperature T, compare T to a predefined temperature value $T_o$, and generate a current terminating signal when T substantially matches $T_o$. The current interrupting device is electrically connected with the source of electrical energy and in signal communication with the computing device. The current interrupting device is configured to terminate (e.g., switch off) the electrical current generated by the source of electrical energy when a current terminating signal is received from the computing device.

In another embodiment, the temperature monitoring device is selected from a group consisting of a thermocouple, a pyrometer, thermographic camera, a resistance temperature detector, or combinations thereof.

In another embodiment, the current interrupting device is selected from a group consisting of a gate turn-off thyristor, a power MOSFET (metal oxide semiconductor field emission transistor), an integrated gate-commutated thyristor, and an insulated gate bipolar transistor, or combinations thereof.

In another embodiment, the source of electrical energy of the RDHF apparatus includes a capacitor.

In another embodiment, the electrical circuit of the RDHF apparatus is a capacitive discharge circuit.

In another embodiment, the shaping tool of the RDHF apparatus includes an injection mold, and monitoring of temperature is achieved by the use of a pyrometer via a fiber-optic feedthrough across the feedstock barrel.

In another embodiment, the shaping tool of the RDHF apparatus includes an injection mold, and monitoring of temperature is achieved by the use of a thermocouple or a resistive temperature detector embedded in the feedstock barrel in proximity to the feedstock.

Additional embodiments and features are set forth in part in the description that follows, and will become apparent to those skilled in the art upon examination of the specification or may be learned by the practice of the disclosed subject matter. A further understanding of the nature and advantages of the disclosure may be realized by reference to the remaining portions of the specification and the drawings, which forms a part of this disclosure.

DETAILED DESCRIPTION

The disclosure is directed to an apparatus including feedback-assisted control of the heating process in rapid discharge heating and forming of metallic glass articles. In some embodiments, the disclosure is directed to an RDHF apparatus including an electrical circuit. The electrical circuit includes a source of electrical energy, at least two electrodes interconnecting the source of electrical energy to a metallic glass feedstock sample, and a feedback control loop. The RDHF apparatus also includes a shaping tool disposed in forming relation to the sample. The feedback control loop can comprise a temperature-monitoring device disposed in a temperature monitoring relationship with the sample configured to generate a signal indicative of the temperature of the sample; a computing device in communication with the temperature-monitoring device and configured to convert the signal from the temperature monitoring device to a sample temperature T, compare T to a predefined temperature value $T_o$, and generate a current terminating signal when T substantially matches $T_o$; and a current interrupting device electrically connected with the source of electrical energy and in signal communication with the computing device, and where the current interrupting device is configured to terminate (e.g., switch off) the electrical current generated by the source of electrical energy when a current terminating signal is received from the computing device.

The RDHF process involves rapidly discharging electrical current across a metallic glass feedstock via electrodes in contact with the feedstock in order to rapidly and uniformly heat the feedstock to a temperature conducive for viscous flow. A deformational force is applied to the heated and softened feedstock to deform the heated feedstock into a desirable shape. The steps of heating and deformation are performed over a time scale shorter than the time required for the heated feedstock to crystallize. Subsequently, the deformed feedstock is allowed to cool to below the glass transition temperature, typically by contact with a thermally conductive metal mold or die in order to vitrify it into an amorphous article.

RDHF techniques are methods of uniformly heating a metallic glass rapidly using Joule heating (e.g. heating times of less than 1 s, and in some embodiments less than 100 milliseconds), softening the metallic glass, and shaping it into a net shape article using a shaping tool (e.g. an extrusion die or a mold). In some embodiments, the methods can utilize the discharge of electrical energy (e.g. 50 J to 100 kJ) stored in an energy source to uniformly and rapidly heat a sample of a metallic glass to a "process temperature" between the glass transition temperature $T_g$ of the metallic glass and the equilibrium melting point of the metallic glass forming alloy $T_m$ on a time scale of several milliseconds or less, and is referred to hereinafter as rapid discharge heating and forming (RDHF).

An "RDHF apparatus," as disclosed in U.S. Pat. No. 8,613,813, includes a metallic glass feedstock, a source of electrical energy, at least two electrodes interconnecting the source of electrical energy to the metallic glass feedstock where the electrodes are attached to the feedstock such that connections are formed between electrodes and feedstock, and a shaping tool disposed in forming relation to the feedstock. In some embodiments, the metallic glass feedstock can have a uniform cross-section. The feedstock having a uniform cross-section means that the cross-section along the length of the feedstock does not vary by more than 20%. In other embodiments, the feedstock having a uniform cross-section means that the cross-section along the length of the feedstock does not vary by more than 10%. In yet other embodiments, the feedstock having a uniform cross-section means that the cross-section along the length of the feedstock does not vary by more than 5%. In yet other embodiments, the feedstock having a uniform cross-section means that the cross-section along the length of the feedstock does not vary by more than 1%.

In some embodiments, the source of electrical energy includes a capacitor. In some embodiments, the source of electrical energy includes a capacitor connected to at least one current interrupting device selected from a gate turn-off thyristor, a power MOSFET (metal oxide semiconductor field emission transistor), an integrated gate-commutated thyristor, and an insulated gate bipolar transistor. In some embodiments, the shaping tool is selected from the group consisting of an injection mold, a dynamic forge, a stamp forge and a blow mold. In some embodiments, the shaping tool is operated by a pneumatic drive, magnetic drive, or electrical drive. An "RDHF apparatus" where the shaping tool is an injection mold, as disclosed in U.S. Patent Application Publication No. 2013/0025814, also includes a "feedstock barrel" to electrically insulate and mechanically confine the feedstock.

In the RDHF process, controlling the heating of the feedstock such that the feedstock reaches a selected process temperature in the undercooled liquid region is important, because the temperature of the feedstock in the undercooled liquid region determines the viscosity of the feedstock and the time window in which the feedstock is stable against crystallization. The viscosity and time window of stability against crystallization are, in turn, critical in determining the success of the RDHF process. In some embodiments of the RDHF process, the viscosity is in the range of $10^0$ to $10^4$ Pa-s, while in other embodiments, the viscosity is in the range of $10^1$ to $10^3$ Pa-s. If the viscosity is very high (i.e. higher than $10^4$ Pa-s), a high pressure may be needed in order to shape the undercooled liquid and form an amorphous article. On the other hand, if the viscosity is very low (i.e. lower than $10^0$ Pa-s), the shaping process may become unstable causing flow instabilities that may result in structural and cosmetic defects in the amorphous article. The time window of stability against crystallization must be large enough that the heating and forming process are completed prior to the onset of crystallization. In some embodiments of the RDHF process the time window of stability against crystallization is at least 10 ms, while in other embodiments the time window is at least 100 ms.

Figure 2:
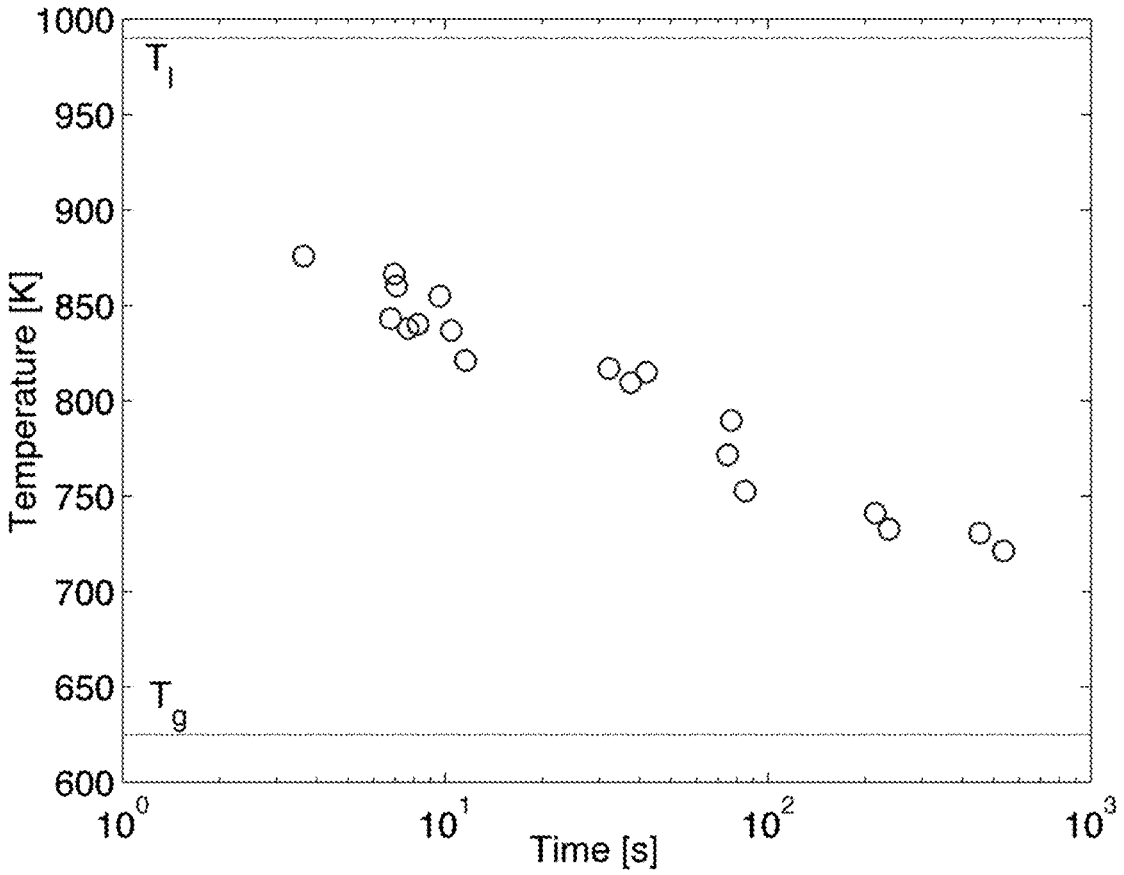
FIG. 2 presents a plot of the time window of stability against crystallization of example metallic glass $Zr_{41.2}Ti_{13.8}Cu_{12.5}Ni_{10}Be_{22.5}$ against temperature in the undercooled liquid region (i.e. between the glass-transition temperature, $T_g$, and liquidus temperature, $T_l$,) in accordance with embodiments of the disclosure.

Both the viscosity and the time window of stability against crystallization may vary over many orders of magnitude against temperature in the undercooled liquid region. Specifically, the viscosity varies hyper-exponentially while the time window of stability against crystallization varies exponentially against temperature. As shown in FIG. 1, the viscosity of example metallic glass $Zr_{41.2}Ti_{13.8}Cu_{12.5}Ni_{10}Be_{22.5}$ varies by about 12 orders of magnitude against temperature in the undercooled liquid region (i.e. between the glass-transition temperature, $T_g$, and liquidus temperature, $T_l$) (the data in FIG. 1 are taken from A. Masuhr, T. A. Waniuk, R. Busch, W. L. Johnson, *Phys. Rev. Lett.* 82, 2290 (1999), the disclosure of which is incorporated herein by reference). And as shown in FIG. 2, the time window of stability against crystallization of example metallic glass $Zr_{41.2}Ti_{13.8}Cu_{12.5}Ni_{10}Be_{22.5}$ varies by about at least 3 orders of magnitude against temperature in the undercooled liquid region (i.e. between the glass-transition temperature, $T_g$, and liquidus temperature, $T_l$) (the data in FIG. 2 are taken from Schroers, A. Masuhr, W. L. Johnson, R. Busch, *Phys. Rev. B* 60, 11855 (1999), the disclosure of which is incorporated herein by reference). Because both variables, i.e. viscosity and time window of stability against crystallization, vary strongly (i.e. exponentially or hyper-exponentially) with temperature in the undercooled liquid region, accurate control of the heating in the RDHF process such that a target process temperature may be attained associated with a desired viscosity and time window of stability against crystallization is important.

In conventional RDHF apparatuses where the source of electrical energy includes a capacitor, heating of the feedstock or feedstock sample to attain a certain process temperature may be controlled by adjusting the voltage of the capacitors. By setting a certain discharge voltage V in a capacitive discharge circuit of capacitance C, a certain electrical current I is discharged through the RDHF circuit, and an associated electrical energy is dissipated within the resistors in the RDHF circuit. The total dissipated electrical energy $E_t$ may be approximated by the relation $E_t \approx 0.5CV^2$. A part of the energy $E_t$ is dissipated within the feedstock, denoted as E. The fraction $E/E_t$ may be related to the ratio of the feedstock resistance, denoted as R, over the total resistance of the RDHF electrical circuit 300 (including the resistance of feedstock sample 302), denoted as $R_t$, i.e. $E/E_t \approx R/R_t$. Part of the energy E dissipated within the feedstock sample 302 is used to heat the feedstock sample 302 from an initial sample temperature $T_i$ to a final sample temperature T, while another part is absorbed at the glass transition as recovery enthalpy. The energy dissipated within the feedstock E may be approximately related to the feedstock process temperature T according to $E=\Omega\int c_p dT$, where $c_p$ is the temperature dependent heat capacity of the feedstock in $J/m^3$-K, Ω is the volume of the feedstock in $m^3$, ΔH is the recovered enthalpy during the glass transition of the feedstock, and $\int c_p dT$ is the temperature integral of $c_p$ from an initial feedstock temperature $T_i$ to a final process temperature T. Substituting the approximate relations for E and $E/E_t$ and solving for V, one may arrive at the following approximate relation between V and T:

$$V=\sqrt{[2(\int c_p dT)\Omega R_t/RC]} \quad \text{EQ. (1)}$$

In theory, EQ. (1) above may be used to determine the voltage V in order to heat the feedstock from an initial temperature $T_i$ to a final process temperature T provided that Ω, $R_t$, R, C, and $c_p$ as a function of temperature, i.e. $c_p(T)$, are known. In practice though, this equation is difficult to solve accurately, because $c_p(T)$ is a complicated function involving different temperature dependencies below and above the glass-transition temperature $T_g$ (i.e. in the glass and liquid states), and a recovery enthalpy at $T_g$. The recovery enthalpy at $T_g$ is actually a function of $T_g$, and $T_g$ itself is a function of the heating rate through the glass transition. Approximations can be made for $\int c_p dT$, but these approximations are generally not completely accurate. As such, the accuracy and overall utility of EQ. (1) in predicting the voltage V to achieve a desired feedstock process temperature T is quite limited. Accordingly, EQ. (1) may only be useful as a guide, and precise heating to a desired feedstock temperature T may only be achieved iteratively by conducting several experiments to determine the corresponding V.

Hence an RDHF apparatus with a capability to accurately control the heating of the feedstock such that an appropriate feedstock process temperature T can be achieved is desirable. The disclosure is directed to an apparatus including feedback-assisted control of the heating process in rapid discharge heating and forming of metallic glass articles.

Figure 3:
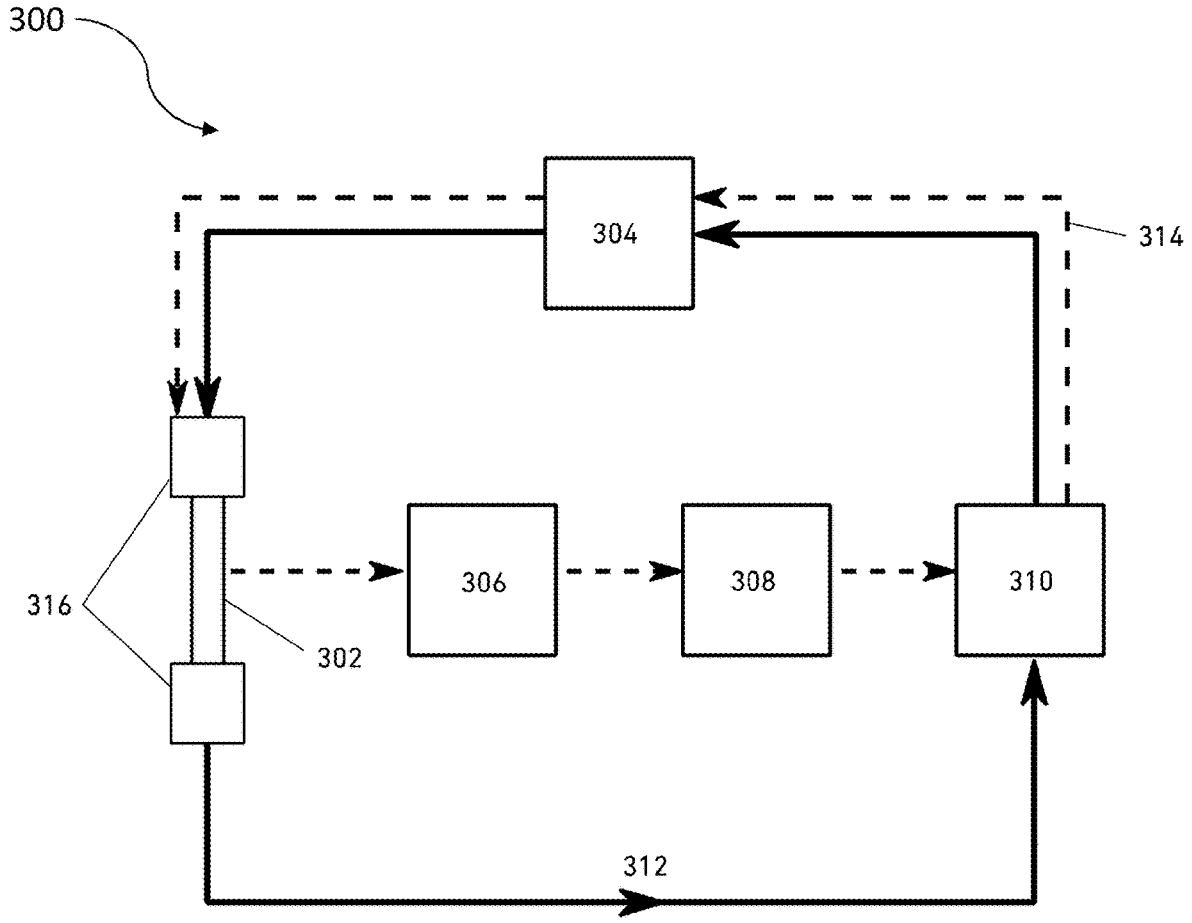
FIG. 3 presents a schematic illustrating the RDHF electrical circuit that includes the feedback control loop in accordance with embodiments of the disclosure.

In some embodiments, the disclosure is directed to an RDHF apparatus including an electrical circuit that includes a feedback control loop. FIG. 3 presents a schematic of the RDHF electrical circuit that includes a feedback control loop in accordance with embodiments of the disclosure. The RDHF electrical circuit 300 includes a metallic glass feedstock sample 302 and an energy source 304 electrically connected to the sample 302 through electrodes 316. The electrical circuit 300 provides an electrical current 312. The RDHF electrical circuit 300 also includes a current interrupting device 310 electrically connected between the sample 302 and the energy source 304. A feedback control loop 314 within the RDHF electrical circuit 300 includes a temperature-monitoring device 306 disposed in temperature monitoring relationship with the sample 302; and a computing device 308 in signal communication with the temperature-monitoring device 306 and current interrupting device 310. The computing device 308 is configured to receive an input signal from the temperature-monitoring device 306 and to also send an output signal to the current-interrupting device 310. Specifically, the computing device 308 is configured to convert a signal from the temperature-monitoring device 306 to a sample temperature T, compare the sample temperature T to a predefined temperature value $T_o$, and send an activation signal to activate the current-interrupting device 310 when the sample temperature T substantially matches the predefined temperature value $T_o$. When activated, the current interrupting device 310 terminates (e.g., switches off) the electrical current through the RDHF electrical circuit 300 such that the heating process is terminated and the predefined temperature value T stabilizes substantially close to the predefined temperature value $T_o$.

In the context of the disclosure, a "temperature-monitoring device" means a device capable of real-time monitoring or measuring of the temperature of the feedstock. In various embodiments, a "temperature-monitoring device" can be a thermocouple, a pyrometer, thermographic camera, a resistance temperature detector, or combinations thereof. In some embodiments, the response time of the "temperature monitoring device" is less than 10 ms, while in other embodiments less than 1 ms, while in other embodiments less than 0.1 ms, while in yet other embodiments less than 0.01 ms.

In the context of the disclosure, a "computing device" means a device capable of being programmed to carry out a set of arithmetic or logical operations automatically.

In the context of the disclosure, a "current interrupting device" means a device electrically connected with the source of electrical energy capable of terminating or terminates (e.g., switches off) the electrical current passing through the RDHF circuit, including the feedstock, when activated by a signal. In some embodiments, the current interrupting device is a gate turn-off thyristor, a power MOSFET (metal oxide semiconductor field emission transistor), an integrated gate-commutated thyristor, an insulated gate bipolar transistor, or combinations thereof. In some embodiments, the response time of the "current interrupting device" is less than 1 ms, while in other embodiments less than 0.1 ms, while in other embodiments less than 0.01 ms, while in yet other embodiments less than 0.001 ms.

In some embodiments of the disclosure, "T substantially matches $T_o$" means the value of T is within 10% of $T_o$ where T and $T_o$ are in absolute "Kelvin" units. In one embodiment, "T substantially matches $T_o$" means the value of T is within 5% of $T_o$, where T and $T_o$ are in absolute "Kelvin" units. In another embodiment, "T substantially matches $T_o$" means the value of T is within 3% of $T_o$ where T and $T_o$ are in absolute "Kelvin" units. In another embodiment "T substantially matches $T_o$" means the value of T is within 2% of $T_o$, where T and To are in absolute "Kelvin" units. In yet another embodiment "T substantially matches $T_o$" means the value of T is within 1% of $T_o$ where T and $T_o$ are in absolute "Kelvin" units.

In other embodiments of the disclosure, "T substantially matches $T_o$" means the absolute difference between T and $T_o$ is not more than 20° C. In one embodiment, "T substantially matches $T_o$" means the absolute difference between T and $T_o$ is not more than 10° C. In another embodiment, "T substantially matches $T_o$" means the absolute difference between T and $T_o$ is not more than 5° C. In another embodiment "T substantially matches $T_o$" means the absolute difference between T and $T_o$ is not more than 2° C. In yet another embodiment "T substantially matches $T_o$" means the absolute difference between T and $T_o$ is not more than 1° C.

In other embodiments, the shaping tool of the RDHF apparatus may be an injection mold, and the temperature-monitoring device can monitor the sample temperature via a fiber-optic feedthrough across the feedstock barrel.

In other embodiment, the shaping tool of the RDHF apparatus may be a blow-molding die, a forging die, or an extrusion die. In other embodiments, any source of electrical energy suitable for supplying sufficient energy to rapidly and uniformly heat the sample 302 to a process temperature T. In one embodiment, the energy source 304 may include a capacitor having a discharge time constant of from 10 μs to 100 ms.

The electrodes 306 may be any electrically conducting electrodes suitable for providing uniform contact across the sample 302 and electrically connect the sample to the energy source 304. In one embodiment, the electrodes are formed of a an electrically conducting metal, such as, for example, Ni, Ag, Cu, or alloys made using at least 95 at % of Ni, Ag and Cu.

Figure 4:
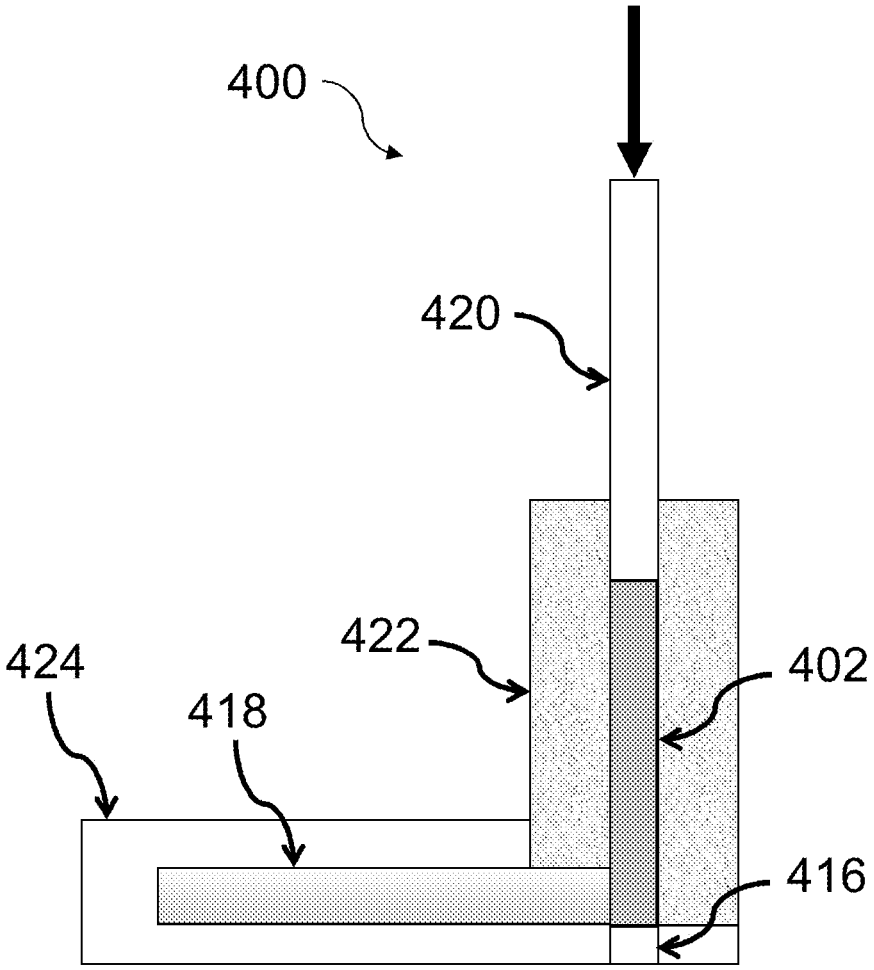
FIG. 4 is a schematic illustrating an RDHF apparatus including a temperature-monitoring device in accordance with embodiments of the disclosure.

Turning to the shaping method itself, a schematic of an exemplary shaping tool representing an injection mold in accordance with the RDHF method of the disclosure is provided in FIG. 4. In one embodiment, shown schematically in FIG. 4, a system 400 represents an injection molding shaping tool in accordance with the RDHF method. As shown, the basic RDHF injection mold includes a sample 402, held between a mechanically loaded plunger 420, which also acts as the top electrode, and rests on an electrically grounded base electrode 416. The plunger 420 may also act as the top electrode, and may be made of a conducting material (such as copper or silver) having both high electrical conductivity and thermal conductivity. The sample 402 is contained within a "barrel" or "shot sleeve" 422 that electrically insulates the sample 402 from a mold 424, and is in fluid communication with a mold cavity 418 contained within the mold 424. In such an embodiment, the electrical current provided to the RDHF electrical circuit is discharged uniformly through the metallic glass sample 402 provided that certain criteria discussed above are met. The loaded plunger 420 then drives the viscous melt of the heated sample 402 such that the melt is is injected into the mold cavity to form a net shape component of the metallic glass.

The RDHF method sets forth two criteria, which must be met to prevent the development of a temperature inhomogeneity thus ensuring uniform heating of the sample: uniformity of the current within the sample; and stability of the sample with respect to development of inhomogeneity in power dissipation during dynamic heating.

Although these criteria seem relatively straightforward, they place a number of physical and technical constraints on the electrical charge used during heating, the material used for the sample, the shape of the sample, and the interface between the electrode used to introduce the charge and the sample itself.

Uniformity of the current within the sample during capacity discharge requires that the electromagnetic skin depth of the dynamic electric field is large compared to relevant dimensional characteristics of the sample (radius, length, width or thickness). In the example of a cylindrical sample, the relevant characteristic dimensions would obviously be the radius and length of the sample, R and L. Hence, uniform heating within a cylindrical sample may be achieved when the electromagnetic skin depth of the dynamic electric field is greater than R and L.

Figure 5:
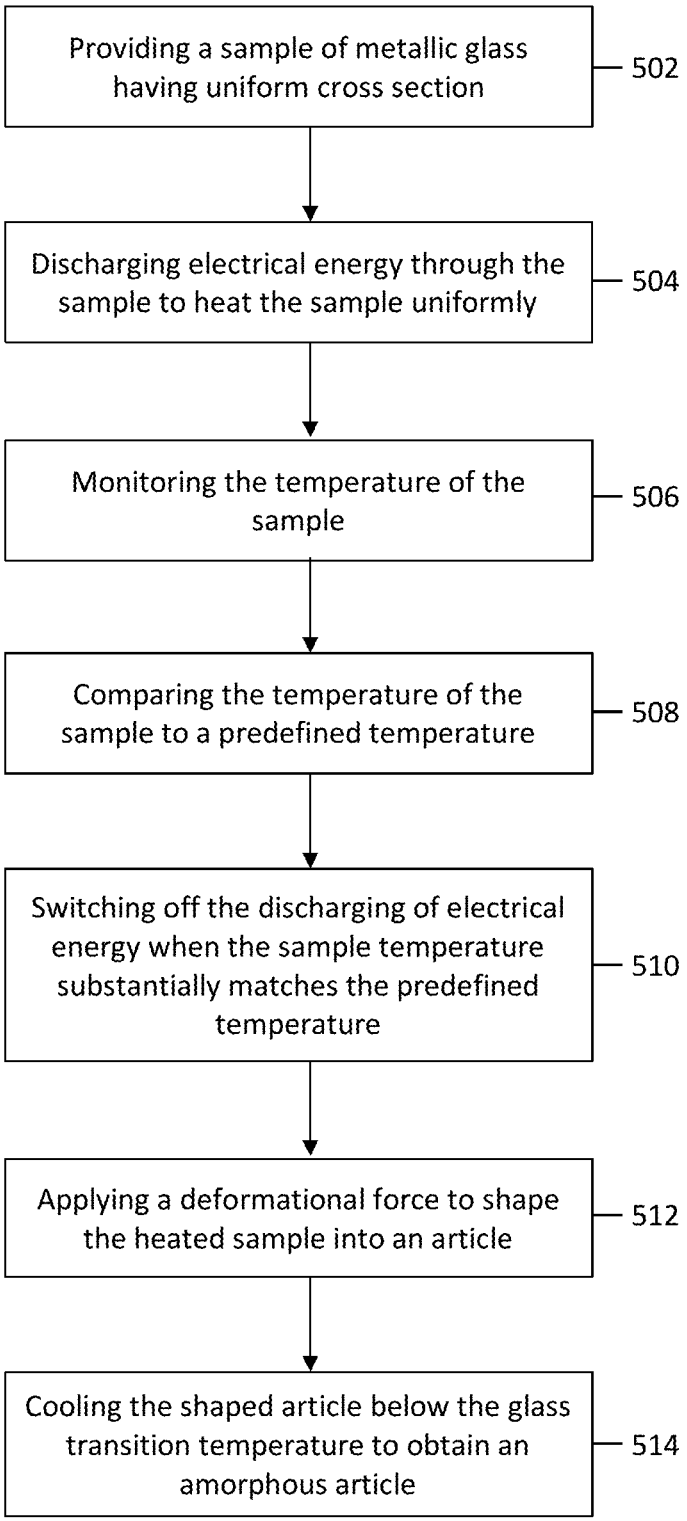
FIG. 5 is a flow chart illustrating the steps of RDHF methods including monitoring sample temperature in accordance with embodiments of the disclosure.

A simple flow chart of the RDHF technique of the disclosure is provided in FIG. 5. As shown, the RDHF process begins with providing a sample of metallic glass having a uniform cross-section at operation 502.

The process begins with the discharge of electrical energy (in some embodiments in the range of 50 J to 100 KJ) stored in a source of electrical energy (in some embodiments the source of electrical energy may be a capacitor) into a metallic glass sample at operation 504. In accordance with the disclosure, the application of the electrical energy may be used to rapidly and uniformly heat the sample to a predefined "process temperature" $T_o$ above the glass transition temperature of the alloy (in some embodiments $T_o$ is within 50 degrees of the half-way point between the glass transition temperature of the metallic glass and the equilibrium melting point of the metallic glass forming alloy; in other embodiments, $T_o$ is about 200-300 K above $T_g$), on a time scale of several microseconds (in some embodiments in the range of 1 ms to 100 ms), achieving heating rates sufficiently high to suppress crystallization of the alloy at that temperature (in some embodiment, the heating rates are at least 500 K/s). The predefined temperature $T_o$ is determined to be a temperature where the viscous metallic glass alloy has a process viscosity conducive to thermoplastic shaping (in some embodiments in the range of 1 to $10^4$ Pa-s).

Following the discharge of electrical energy, the RDHF process also includes monitoring the temperature of the sample Tat operation 506 by generating a signal indicative of T. The sample temperature monitoring may be performed by a temperature-monitoring device as described earlier. The RDHF process also includes comparing the temperature of the sample to a predefined temperature at operation 508.

The RDHF process further includes converting a signal from the temperature-monitoring device to a sample temperature T, comparing T to a predetermined temperature value $T_o$ and generating a current terminating signal when T substantially matches the predefined process temperature $T_o$. The signal conversion and comparison processes can be performed by the computing device, as described herein.

The RDHF process further includes terminating (e.g., switching off) the electrical current generated by the source of electrical energy when a current terminating signal is received at operation 510. The current termination process can be performed by a current terminating device as described earlier.

Once the current is terminated after the sample reaches a uniform temperature that substantially matches the predefined process temperature $T_o$, the RDHF process may also include shaping of the viscous sample into an amorphous bulk article at operation 512.

Lastly, the RDHF process may also include cooling the article below the glass transition temperature of the metallic glass sample at operation 514. In some embodiments, the shaping and cooling steps are performed simultaneously.

In some embodiments, the present feedback control loop can be incorporated into the electrical circuit of any existing rapid capacitive discharging forming (RCDF) apparatus, such as disclosed in the following patents or patent applications: U.S. Pat. No. 8,613,813, entitled "Forming of metallic glass by rapid capacitor discharge;" U.S. Pat. No. 8,613,814, entitled "Forming of metallic glass by rapid capacitor discharge forging"; U.S. Pat. No. 8,613,815, entitled "Sheet forming of metallic glass by rapid capacitor discharge;" U.S. Pat. No. 8,613,816, entitled "Forming of ferromagnetic metallic glass by rapid capacitor discharge;" U.S. 9,297,058, entitled "Injection molding of metallic glass by rapid capacitor discharge;" each of which is incorporated by reference in its entirety.

The RDHF shaping techniques and alternative embodiments discussed above may be applied to the production of complex, net shape, high performance metal components such as casings for electronics, brackets, housings, fasteners, hinges, hardware, watch components, medical components, camera and optical parts, jewelry etc. The RDHF method can also be used to produce sheets, tubing, panels, etc., which could be shaped through various types of molds or dies used in concert with the RDHF apparatus.

The methods and apparatus herein can be valuable in the fabrication of electronic devices using bulk metallic glass articles. In various embodiments, the metallic glass may be used as housings or other parts of an electronic device, such as, for example, a part of the housing or casing of the device. Devices can include any consumer electronic device, such as cell phones, desktop computers, laptop computers, and/or portable music players. The device can be a part of a display, such as a digital display, a monitor, an electronic-book reader, a portable web-browser, and a computer monitor. The device can also be an entertainment device, including a portable DVD player, DVD player, Blue-Ray disk player, video game console, music player, such as a portable music player. The device can also be a part of a device that provides control, such as controlling the streaming of images, videos, sounds, or it can be a remote control for an electronic device. The alloys can be part of a computer or its accessories, such as the hard driver tower housing or casing, laptop housing, laptop keyboard, laptop track pad, desktop keyboard, mouse, and speaker. The metallic glass can also be applied to a device such as a watch or a clock.

Having described several embodiments, it will be recognized by those skilled in the art that various modifications, alternative constructions, and equivalents may be used without departing from the spirit of the disclosure. Additionally, a number of well-known processes and elements have not been described in order to avoid unnecessarily obscuring the embodiments disclosed herein. Accordingly, the above description should not be taken as limiting the scope of the document.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and and system, which, as a matter of language, might be said to fall therebetween.

The invention claimed is:

1. A rapid discharge heating and forming (RDHF) apparatus comprising:

an electrical circuit comprising:

a source of electrical energy;

a sample of metallic glass;

at least two electrodes connecting the source of electrical energy to a sample of metallic glass feedstock disposed in a feedstock barrel;

a feedback control loop comprising:

a temperature-monitoring device disposed in temperature monitoring relationship with the sample configured to generate a signal indicative of the temperature of the sample, the temperature-monitoring device coupled to a fiber-optic feedthrough across the feedstock barrel;

a computing device in signal communication with the temperature-monitoring device configured to convert the signal from the temperature-monitoring device to a sample temperature T, compare T to a predefined temperature value $T_o$, and generate a current terminating signal when T substantially matches $T_0$; and a current interrupting device electrically connected with the source of electrical energy and in signal communication with the computing device, and where the current interrupting device is configured to terminate the electrical current generated by the source of electrical energy when the current terminating signal is received from the computing device; and a shaping tool disposed in forming relation to the sample.

2. The RDHF apparatus of claim 1, wherein the temperature-monitoring device is at least one of pyrometer or thermographic camera.

3. The RDHF apparatus of claim 1, wherein the current interrupting device is selected from a group consisting of gate turn-off thyristor, power metal oxide semiconductor field emission transistor (MOSFET), integrated gate-commutated thyristor, and insulated gate bipolar transistor, or combinations thereof.

4. The RDHF apparatus of claim 1, wherein the source of electrical energy of the RDHF apparatus comprises a capacitor.

5. The RDHF apparatus of claim 1, wherein the shaping tool of the RDHF apparatus comprises an injection mold.

6. The RDHF apparatus of claim 1, wherein the shaping tool of the RDHF apparatus comprises an extrusion die.

7. The RDHF apparatus of claim 1, wherein the shaping tool of the RDHF apparatus comprises a forging die.

8. The RDHF apparatus of claim 1, wherein the shaping tool of the RDHF apparatus comprises a blow molding die.

9. A method of rapidly heating and shaping a metallic glass using the RDHF apparatus according to claim 1, the method comprising:

discharging electrical energy uniformly through the sample of metallic glass formed of a metallic glass forming alloy to generate an electrical current that uniformly heats the sample;

monitoring the temperature of the sample;

terminating the electrical current when the temperature of the sample substantially matches a predefined temperature $T_o$, where $T_o$ is between the glass transition temperature of the metallic glass and the equilibrium melting point of the metallic glass forming alloy;

applying a deformational force to shape the heated sample into an article; and cooling the article to a temperature below the glass transition temperature of the metallic glass.

10. The method of claim 9, wherein the electrical energy discharged ranges from 50 J to 100 kJ.

11. The method of claim 9, wherein the electrical energy is at least 100 J and a discharge time constant of between 10 us and 100 ms.

12. The method of claim 9, wherein $T_0$ is within 50 degrees of the half-way point between the glass transition temperature of the metallic glass and the equilibrium melting point of the metallic glass forming alloy.

13. The method of claim 9, wherein the predefined temperature $T_o$ is such that the viscosity of the heated sample is from 1 to $10^4$ Pas-sec.

14. The method of claim 9, wherein the metallic glass is an alloy based on an elemental metal selected from the group consisting of Zr, Pd, Pt, Au, Fe, Co, Ti, Al, Mg, Ni and Cu.

15. The method of claim 9, wherein the step of discharging the electrical energy generates a dynamic electrical field in the sample, and wherein the electromagnetic skin depth of the dynamic electric field generated is larger than at least one of the radius, width, thickness, and length of the sample.

16. The method of claim 9, wherein applying a deformational force comprises a step selected from the group consisting of injection molding, forging, extrusion, and blow molding.

17. The method of claim 9, comprising uniformly heating the sample at a rate of at least 500 K/s.

* * * * *